US006148805A

United States Patent [19]

Bartley et al.

[11] Patent Number: 6,148,805

[45] Date of Patent: Nov. 21, 2000

[54] ENGINE WITH HYDRAULIC FUEL INJECTION AND EGR VALVE USING A SINGLE HIGH PRESSURE PUMP

[75] Inventors: Bradley E. Bartley, Manito; James R. Blass, Bloomington; Dennis H. Gibson, Chillicothe, all of Ill.

[73] Assignee: Caterpillar Inc., Peoria, Ill.

[21] Appl. No.: 09/212,187

[22] Filed: Dec. 15, 1998

[51] Int. Cl.[7] ..... F02M 25/06; F02M 37/04

[52] U.S. Cl. ..... 123/568.28; 123/446

[58] Field of Search ..... 123/568.28, 568.29, 123/568.21, 446, 447, 456

[56] References Cited

U.S. PATENT DOCUMENTS

| | | | |
|---|---|---|---|
| 3,868,062 | 2/1975 | Cunningham | 241/36 |
| 4,043,304 | 8/1977 | Stumpp et al. | 123/119 A |
| 4,334,836 | 6/1982 | Kubis et al. | 417/364 |
| 4,373,496 | 2/1983 | Greiner | 123/568.28 |
| 4,495,929 | 1/1985 | Maeda | 123/568.28 |
| 4,718,385 | 1/1988 | Konrath | 123/568.21 |
| 4,907,560 | 3/1990 | Krieger | 123/568.29 |
| 5,121,730 | 6/1992 | Ausman et al. | 123/467 |
| 5,168,703 | 12/1992 | Tobias | 60/418 |
| 5,176,115 | 1/1993 | Campion | 123/446 |
| 5,485,820 | 1/1996 | Iwaszkiewicz | 123/446 |
| 5,540,203 | 7/1996 | Foulkes et al. | 123/446 |
| 5,706,780 | 1/1998 | Shirakawa | 123/446 |
| 5,894,830 | 4/1999 | Blass | 123/446 |
| 5,924,407 | 7/1999 | Iwaszkiewicz | 123/446 |

*Primary Examiner*—Carl S. Miller
*Attorney, Agent, or Firm*—Eric M. Bram

[57] ABSTRACT

An engine system comprises a hydraulically actuated fuel injection system and an EGR valve circuit connected via a fluid flow passage that provides hydraulic fluid to both the fuel injection system and to the EGR valve circuit. The hydraulically actuated system includes a high pressure pump. The fluid control passage is in fluid communication with an outlet from the high pressure pump.

13 Claims, 2 Drawing Sheets

ENGINE WITH HYDRAULIC FUEL INJECTION AND EGR VALVE USING A SINGLE HIGH PRESSURE PUMP

This invention was made with Government support under DOE contract No. DE-AC05-970R22605 awarded by the United States Department of Energy. The Government has certain rights in this invention.

TECHNICAL FIELD

The invention relates generally to engines having both hydraulic fuel injection and an EGR valve, and more specifically to hydraulic fuel injection and an EGR valves driven by a single pump.

BACKGROUND

A device commonly used on internal combustion engines to help reduce exhaust emissions is an Exhaust Gas Recirculation (EGR) valve. Nitrogen oxides (NOx) are formed when the temperatures in the combustion chamber get too high. The EGR valve recirculates engine exhaust gases into the intake stream of the engine, thus cooling the combustion process by several hundred degrees and reducing nitrogen oxides.

Gasoline engines rely on a vacuum generated from the engine for the EGR valve's actuation. However, diesel engines which do not produce vacuums must be equipped with vacuum pumps to operate EGR valves.

Vacuum operated EGR valves use diaphragms. The polymer diaphragms of vacuum EGR valves operate in a very harsh environment resulting in serious reliability problems.

The invention is directed to overcoming one or more of the problems set forth above.

SUMMARY OF THE INVENTION

An engine system comprises a hydraulically actuated fuel injection system and an EGR valve circuit connected via a fluid flow passage that provides hydraulic fluid to both the fuel injection system and to the EGR valve circuit. The hydraulically actuated system includes a high pressure pump. The fluid control passage is in fluid communication with an outlet from the high pressure pump .

BEST MODE FOR CARRYING OUT THE INVENTION

Figure 1:
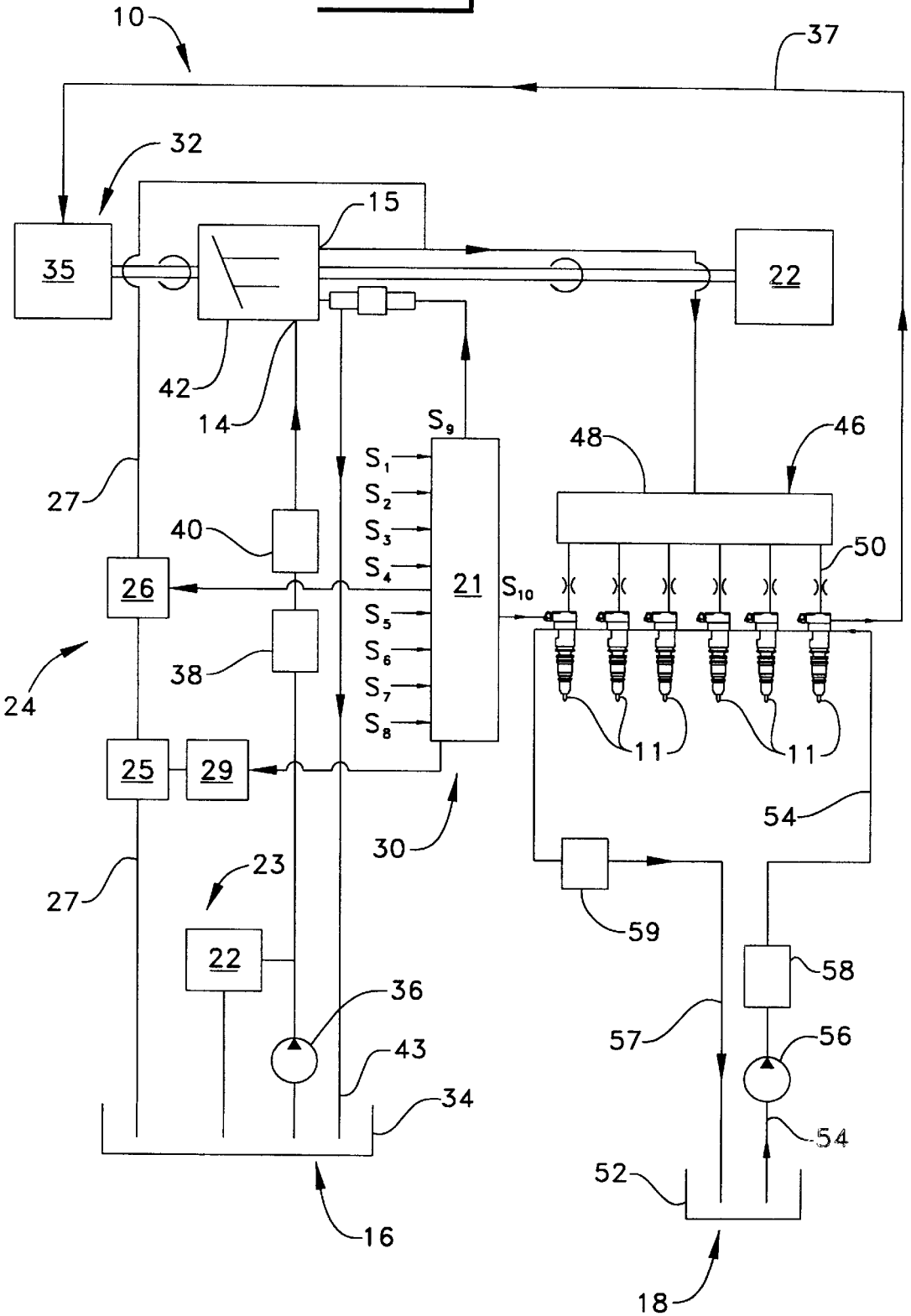
FIG. 1 is a schematic view of a hydraulically-actuated fuel injection system and EGR valve according to the invention.
Figure 2:
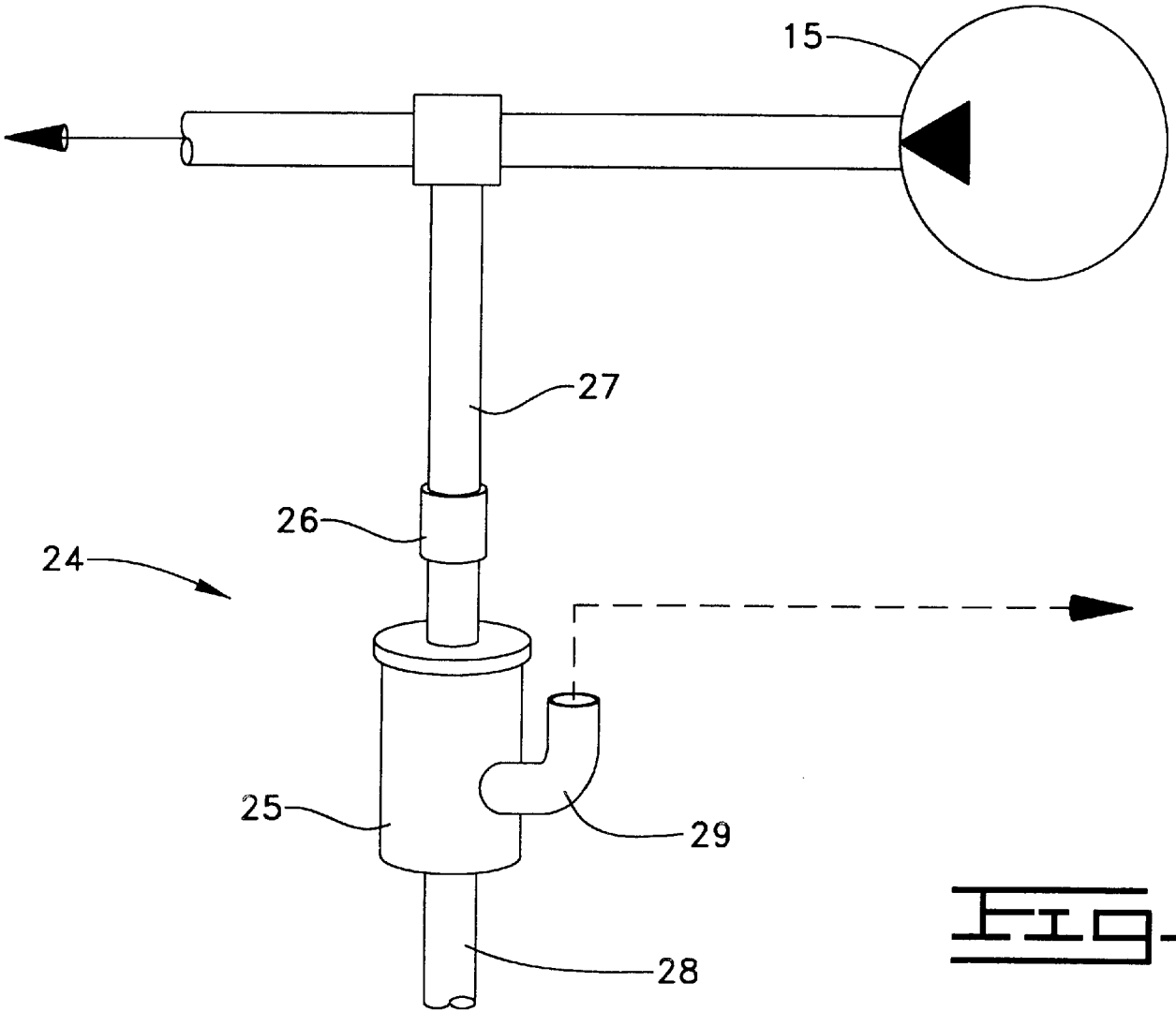
FIG. 2 is a diagrammatic perspective view of a portion of the system according to the invention.

FIGS. 1 and 2 are diagrammatic representations of an EGR valve circuit 24 used with a hydraulically actuated fuel injection system 10 as adapted for a direct injection diesel cycle internal combustion engine 22. The fuel injection system 10 includes one or more fuel injectors 11, all of which are adapted to be positioned in a respective cylinder head bore of engine 22. The fuel injection system 10 includes a source of actuation fluid 16 that supplies actuation fluid to each fuel injector 11, as well as to an engine lubricating circuit 23 and EGR valve circuit 24. While any available engine fluid could be used as the actuation fluid in this system, the invention preferably utilizes engine lubricating oil. This allows fuel injection system 10 to be connected directly to engine lubricating circuit 23. The fuel injection system 10 also includes a source of fuel 18 for supplying fuel to each fuel injector 11. A means for recirculating actuation fluid 32 containing an EGR valve 35 is included in fuel injection system 10. The means for recirculating actuation fluid 32 is capable of recovering energy from the actuation fluid leaving each of the fuel injectors 11. A computer 30 is also included in fuel injection system 10 to control timing and duration of injection events.

The source of actuation fluid 16 preferably includes an actuation fluid pan 34, an actuation fluid cooler 38, one or more actuation fluid filters 40 and a low pressure pump 36 for supplying oil or actuation fluid to both engine lubricating circuit 23 and fuel injection system 10. The source of actuation fluid 16 also preferably includes high pressure pump 42 for generating high pressure in the actuation fluid and at least one high pressure manifold 46. High pressure pump 42 includes an inlet 14 connected to an outlet of low pressure pump 36, and an outlet 15. Both EGR valve circuit 24 and high pressure manifold 46 are connected to outlet 15. The location of EGR valve circuit 24 as related to high pressure manifold 46 is a matter of design choice. For instance, EGR valve circuit 24 could be connected to high pressure manifold 46 at a downstream location instead of in the manner shown in FIG. 1.

A rail branch passage 50 connects a high pressure actuation fluid inlet of each fuel injector 11 to high pressure common rail 48. Actuation fluid exiting fuel injector 11 flows through a low pressure actuation fluid drain that is connected to the means for recirculating actuation fluid 32 via a recirculation passage 37. A portion of the recirculated actuation fluid is channeled to high pressure pump 42 and another portion is returned to actuation fluid pan 34 via a recirculation line 43 and recirculated by low pressure pump 36.

Actuation fluid is delivered to EGR valve circuit 24 by high pressure pump 42 via a flow passage 27 that branches from high pressure pump 42. EGR valve circuit 24 preferably includes a flow regulating valve 26, an EGR valve 25, and EGR terminal 29 and an actuation fluid return passage 28. Actuation fluid can flow into EGR valve circuit 24 through outlet 15 via flow passage 27. Actuation fluid is channeled through flow passage 27 to flow regulating valve 26. The flow regulating valve 26 is required when it is desirable for EGR valve circuit 24 to operate at a different pressure than fuel injection system 10. The flow regulating valve 26 passes hydraulic fluid to the EGR valve 25. Actuation fluid is returned to the hydraulic fluid source 16 via actuation fluid return passage 28.

The source of fuel 18 preferably includes a fuel supply regulating valve 59 and a fuel circulation and return passage 57 arranged in fluid communication between fuel injectors 11 and fuel tank 52. Fuel is supplied to fuel injectors 11 via a fuel supply passage 54 arranged in fluid communication between fuel tank 52 and the fuel inlet of each fuel injector 11. Fuel being supplied through fuel supply passage 54 travels through a low pressure fuel transfer pump 56 and one or more fuel filters 58.

Fuel injection system 10 is electronically controlled via computer 30 that includes an electronic control module 21 that controls the timing and duration of injection events and pressure in high pressure manifold 46. Based upon a variety of input parameters including temperature, throttle, engine load, etc. (S1–S8) electronic control module 21 can determine a desired injection timing duration and manifold pressure to produce some desired performance at the sensed operating conditions. The electronic control module 21 can also be used for control of the EGR valve, via the EGR terminal 29. Electronic control module 21 could also control the flow regulating valve 26 included in the EGR valve circuit 24, if desired.

INDUSTRIAL APPLICABILITY

A typical actuation fluid used by the invention is engine lubricating oil. Actuation fluid pumped by low pressure pump 36 is directed through engine lubricating circuit 23. After this actuation fluid has performed work in engine lubricating circuit 23 it flows back into actuation fluid pan 34 where it will be recirculated. A portion of oil pumped by low pressure pump 36 is channeled to high pressure pump 42 rather than to engine lubricating circuit 23.

Actuation fluid pumped by high pressure pump 42 is directed to both EGR valve circuit 24 and high pressure manifold 46. A first amount of actuation fluid exits high pressure pump 42 through outlet 15 and flows into EGR valve circuit 24 via flow passage 27 and through flow regulating valve 26. This first amount of actuation fluid is returned via actuation fluid return passage 28 for recirculation upon exiting the EGR valve 25. A second amount of actuation fluid exits high pressure pump 42 through outlet 15 and flows to high pressure manifold 46. The actuation fluid flows into fuel injectors 11 via a series of rail branch passages 50 from high pressure manifold 46. After performing work in fuel injectors 11, actuation fluid flows through recirculation passage 37 to actuation fluid pan 34 for recirculation.

Utilizing the existing hydraulic actuation power of the hydraulically actuated fuel injection system in this way, the vacuum pump needed to operate the EGR valves can be eliminated. Additionally, the invention improves upon previous EGR valves by eliminating the polymer diaphragms required in vacuum EGR valves. The hydraulically actuated EGR valves would thus much more reliable than those actuated by vacuum because their components could withstand the extreme operating conditions that exist within combustion engines.

It should be understood that the above description is intended only to illustrate the concepts of the invention, and is not intended to in any way limit the potential scope of the invention. For instance, while the present system utilizes engine lubricating oil as actuation fluid to allow the hydraulic system and EGR valve to be directly connected to the engine lubricating system, it should be appreciated that the actuation fluid could be supplied from a separate source and the engine lubricating system could be made separate. Thus, various modifications could be made without departing from the intended spirit and scope of the invention as defined by the claims below.

What is claimed is:

1. A combined hydraulic and EGR valve system comprising:

a high pressure pump having at least one outlet;

an EGR valve circuit having a flow passage with one end fluidly connected to the at least one outlet; and a hydraulic circuit having a plurality of hydraulically actuated devices with inlets fluidly connected to the at least one outlet, wherein the EGR valve passage further includes a flow passage fluidly connected to a fluid reservoir;

the hydraulic devices having outlets fluidly connected to the fluid reservoir; and the high pressure pump having an inlet fluidly connected to the fluid reservoir.

2. The system of claim 1 further comprising an electronic control module in communication with and being capable of controlling the hydraulically actuated devices.

3. The system of claim 1 wherein the high pressure pump includes an inlet connected to a source of engine lubricating oil.

4. A combined hydraulically actuated fuel injection and EGR valve comprising:

a high pressure pump having an inlet fluidly connected to a source of fluid and at least one outlet;

an EGR valve circuit having a flow passage fluidly connected to the at least one outlet;

a high pressure common rail fluidly connected to the at least one outlet; and a plurality of hydraulically actuated fuel injectors fluidly connected to the common rail.

5. The combined system of claim 4 wherein the source of fluid is an actuation fluid pan.

6. The combined system of claim 4 wherein each of the fuel injectors includes a fuel inlet fluidly connected to a source of fuel fluid, and a hydraulic fluid inlet fluidly connected to the common rail.

7. The combined system of any of claims 4 through 6, further comprising an electronic control module in communication with and being capable of controlling the hydraulically actuated fuel injectors.

8. The combined system of claim 4, further comprising a rail pressure control device attached to the common rail.

9. A method for operating a motor vehicle, comprising:

using a high pressure pump to feed high-pressure hydraulic fluid to both an EGR valve circuit and a high pressure common rail;

supplying high-pressure hydraulic fluid from the common rail to a plurality of hydraulically actuated fuel injectors; and using the high-pressure hydraulic fluid from the common rail to actuate the plurality of hydraulically actuated fuel injectors.

10. The method of claim 9, further comprising using an electronic control module in communication with the plurality of hydraulically actuated fuel injectors to regulate operation of the plurality of hydraulically actuated fuel injectors.

11. The method of claim 9 or 10, further comprising attaching a rail pressure control device to the common rail.

12. The method of claim 9 or 10, further comprising outputting hydraulic fluid from the plurality of hydraulically actuated fuel injectors to at least one fluid reservoir, and feeding hydraulic fluid from the fluid reservoir to the high pressure pump.

13. The method of claim 12, further comprising providing a flow passage for fluidly connecting the EGR valve and the fluid reservoir.

* * * * *